United States Patent [19]

Dempsey et al.

[11] Patent Number: 5,019,111

[45] Date of Patent: May 28, 1991

[54] FASCIA PANEL STRUCTURES

[75] Inventors: William F. Dempsey, Acton; Steve Casar, Etobicoke; Charles P. Reed, Scarborough, all of Canada

[73] Assignee: Alcan International Limited, Montreal, Canada

[21] Appl. No.: 206,570

[22] Filed: Jun. 14, 1988

[51] Int. Cl.[5] ..... B04B 1/38

[52] U.S. Cl. ..... 52/506; 52/40; 52/276

[58] Field of Search ..... 52/474, 235, 506–513, 52/582, 584, 276, 40

[56] References Cited

U.S. PATENT DOCUMENTS

| | | | |
|---|---|---|---|
| 2,107,240 | 2/1938 | Eilertsen | 42/474 |
| 2,120,195 | 6/1938 | Valenti | 52/513 |
| 2,161,185 | 6/1939 | Mills | 52/486 |
| 3,885,362 | 5/1975 | Pollock | 52/474 |
| 4,483,122 | 11/1984 | Crandell | 52/235 |
| 4,553,366 | 11/1985 | Guerin | 52/511 |
| 4,813,203 | 3/1989 | Newman et al. | 52/235 |

*Primary Examiner*—James L. Ridgill, Jr.
*Attorney, Agent, or Firm*—Cooper & Dunham

[57] ABSTRACT

The invention provides a new fascia panel structure consisting of a plurality of butting panels disposed side-by-side on a support structure fastened to the building to which the fascia is applied. The support structure consists of two vertically-spaced horizontal parallel rails having upwardly opening channels. The panels each have downwardly extending horizontal top and bottom edges which engage in the channels and can slide sideways therein. Each panel has a channel-forming member fastened to its rear surface adjacent one vertical edge, and a tongue-forming member fastened to the rear surface adjacent the other vertical edge; these can also act as stiffening members. The panels are installed on the horizontal rails and slid sideways until the respective panel tongue is engaged in the adjacent panel channel, the tongue covering any wall gap that may be left to accomodate expansion. The panels are held in place by an elongated horizontal hold-down cap strip that is fastened to the building and engages their top edges. The panels are therefore "free-floating" on their support structure to avoid distortion with changes in ambient temperature, and consequent buckling and "oil-canning". The preferred material for the panels is sheet aluminum, or its alloys, and preferably the other members are of extruded aluminum, or its alloys. Preferably the members are fastened to the rear faces of the panels by glueing, using double-sided adhesive tape.

10 Claims, 3 Drawing Sheets

FASCIA PANEL STRUCTURES

FIELD OF THE INVENTION

The present invention is concerned with improvements in or relating to fascia panel structures and especially, but not exclusively, to such structures employing a plurality of supported decorative panels, as used along the roof line of low rise commercial buildings.

REVIEW OF THE PRIOR ART

It is common in certain types of low rise commercial buildings to provide a fascia along the roof line consisting of a plurality of side-by-side butting panels of standard size, to which decorative coloured coatings and signage components can be applied. The most suitable and economical material for the panels is thin sheet metal, to which various weather resistant coatings can readily be applied, and the successful support of such facings on buildings over the required minimum period of time (5–10 years) is surprisingly difficult, owing to the relatively arduous conditions to which they are subjected. For example, in Canada the assembled facing must be able to withstand winter freezing and direct summer sun with ambient temperatures of from about −30° C. to 50° C. (−30° F. to 150° F.), and remain firmly in place while subjected to winds of up to 200 kph (125 mph). The wide range in these ambient temperatures results in correspondingly large amounts of expansion and contraction of the metal panels, and the solutions adopted to date are relatively unsatisfactory for a number of reasons.

For example, one system uses a bead of flexible caulking interposed between each pair of immediately adjacent panels to absorb the expansion and contraction. The caulking weathers differently from the panels, and in addition tends to pick up dirt from the atmosphere, so that the beads quickly become very obtrusive, detracting from the appearance of the fascia. As the caulking weathers it loses elasticity and in practice it is frequently found that the panels then buckle spoiling the appearance; once this has happened they do not usually return to their original flat state.

Another system employs relatively narrow interlocking panels much like metal siding, the panels being provided with centrally-disposed V-grooves parallel to their longer edges which assist in absorbing the expansion and contraction. Such systems are time consuming to install and require fastening to the supporting wall at frequent intervals along their length. The V-grooves hold dirt and make the fascia difficult to clean, and in addition make it impossible to print signage indicia directly on the panel, so that such identification must be supplied and attached as a separate fixture, considerably increasing expense. Because of the method of fastening the panels together the systems must be fabricated on-site, with all of the problems that are entailed. These panels also are subject to warping and deformation with time.

Both prior systems have the panels firmly fastened in place, and consequently are subject a phenomenom known as "oil-canning", the panels unexpectedly suddenly emitting sharp unpleasant noises as they expand and contract.

DEFINITION OF THE INVENTION

It is therefore the principal object of the present invention to provide a new fascia panel structure operable successfully with thin sheet metal panels.

It is a more specific object to provide such a new fascia panel structure in which the panels are supported so as to be readily assembled in a "free-floating" manner.

In accordance with the present invention there is provided a fascia panel structure including a plurality of panels in side-by-side butting relationship, comprising:

a) two vertically-spaceable, horizontally-extendible panel edge support means fastenable to the structure against which the fascia is to be supported and providing respective horizontal, parallel elongated upwardly-opening panel edge receiving channels;

b) a plurality of said panels each having a front face and respective rearwardly-extending portions along their upper and lower edges, the rearwardly extending portions each terminating in a respective downwardly-extending horizontal edge engageable in the respective support means channel to support the respective panel edge against vertical downward movement while permitting the panel to move freely sideways on the support means;

c) a vertically-extending channel-forming member attached to the rear face of each panel adjacent one vertical edge to provide a vertical tongue-receiving channel between itself and the said panel rear face;

d) a tongue-forming member attached to the rear face of each panel adjacent to the other vertical edge and forming a tongue protruding from the panel edge along its entire length to be engageable in the adjacent vertical tongue-receiving channel and bridge any gap between the adjacent panels; and e) a hold down member fastenable to the said structure and engageable with the top edge of each panel to hold it against vertical movement and so that the said panel rearwardly-extending portions remain engaged in said support means channels.

Preferably, the said channel and tongue forming members are glued to the panel rear face by double sided adhesive tape interposed between the members and the panel rear face.

Preferably, said hold down member is a continuous strip extending over the panels and closing the horizontal gap between the panels and the structure on which the fascia is supported.

DESCRIPTION OF THE DRAWINGS

Particular preferred embodiments of the invention will now be described, by way of example, with reference to the accompanying diagrammatic drawings, wherein.

DESCRIPTION OF THE PREFERRED EMBODIMENT

Figure 1:
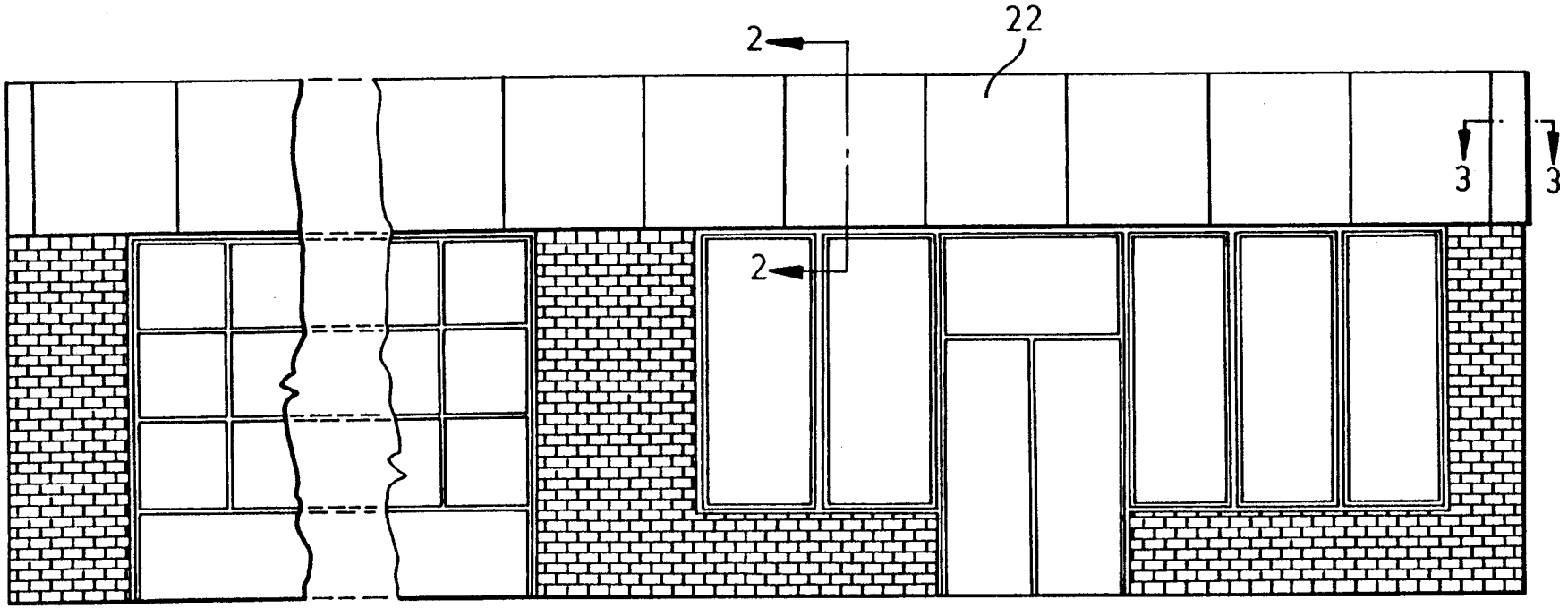
FIG. 1 is a front elevation of a portion of a wall of a small single-storey commercial building, showing a typical application of the fascia panel structure of the invention.

For convenience in description the invention is described in this application as applied to a flat-roofed small commercial building, namely an automotive service station, with which the panel structure constitutes the decorative upper edge portion of at least the front wall and the immediately adjacent two corners. From this description the application of the invention to other architectural structures will be apparent to those skilled in this particular type of building contruction.

The uppermost part 10 of the building front wall is prepared to receive the fascia structure by the application of a horizontally-extending sheet 12 of a material, such as plywood, that will readily receive and securely hold screw or rivet fasteners, the size of the sheet being such that it is fully concealed by the fascia when installed. The top and bottom edges of the sheet 12 will usually be covered by suitable flashings 14 and 16 to prevent entry of moisture. Installation commences with the attachment to the sheet 12 of two vertically-spaced, parallel horizontally-extending panel support members 18 and 20, which in this embodiment are identical, comprising aluminum extrusions of shallow Z-cross-section having two arms and a connecting web, one of the arms also having a respective extension 18*a* and 20*a* parallel to the connecting web. The extrusions are fastened with one arm abutting the sheet and with the other arm spaced from the sheet by the depth of the web, so as to form a respective upwardly-opening horizontal channel.

The separate panels 22 are formed from thin sheet aluminum, usually of thickness from about 1.0mm to 3.2mm (0.04 in to 0.125 in), preferably 1.6mm (0.064 in). The panels as used in this application normally range in height from 0.3 meters to 2 meters (1 ft to 6 ft) and in width from 0.3 meters to 3.3 meters (1 ft to 10 ft). The top and bottom edge portions are turned rearwards through 90° to form respective horizontal edges, and the free ends of these edge portions are turned through another 90° to extend respectively downward and upward parallel to the front face. Another two shallow Z-cross-section aluminum extrusions 24 and 26, also identical in this embodiment, are fastened to the panel free edges to provide respecti horizontally downwardly-extending vertical edges, each engageable in the respective horizontal channel to support the panel at the required height while permitting its free sliding movement along the parallel channels. The side-by-side panels are held firmly in the channels by a continuous extruded hold down strip member 28 that is fastened to the structure and engages the top edges of the panels. The hold down member also overlies the gap between the panels and the building wall to prevent the entry of moisture, and the seal it provides is usually completed by a bead 29 of a suitable sealant.

Figure 3:
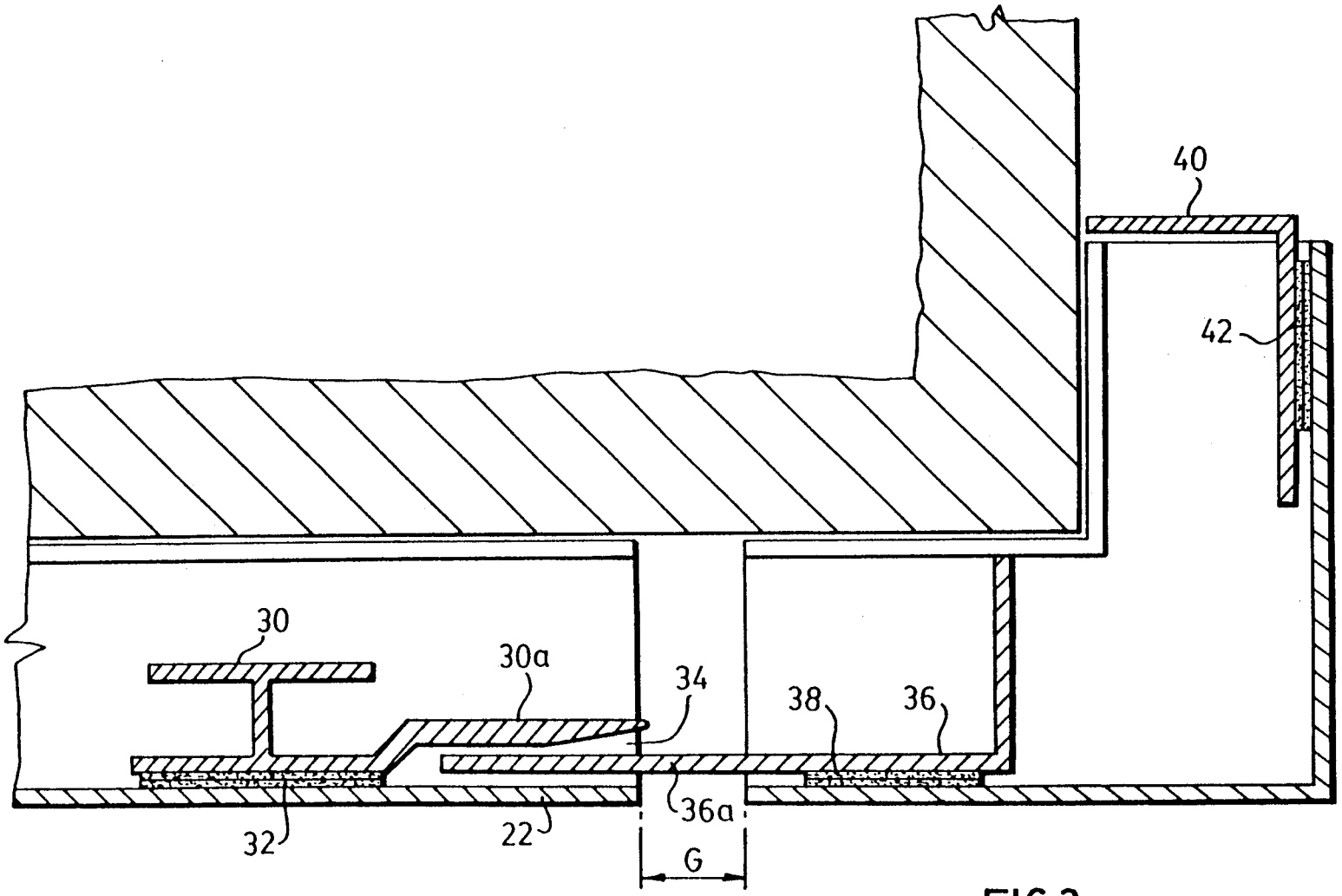
FIG. 3 is a horizontal cross-section taken on the line 3—3 of FIG. 1, also to a larger scale, to show the manner of engagement of the abutting panel vertical edges and also to show the arrangement of a corner.

Referring now particularily to FIG. 3, each panel is provided adjacent one vertical edge with a vertical channel-forming and stiffener member 30 that is fastened to the rear face of the panel by an interposed strip 32 of double-sided adhesive tape, so that the front face of the panel is completely flat and clear of any protrusion that could interfere with the coating and/or signage on the front face. A portion 30*a* of the member is spaced from the panel rear face to form the channel 34 between them, the vertical edge of portion 30*a* terminating in about the same plane as the adjacent vertical panel edge. The remainder of the member 30 is of a cross-section such as to provide the required rigidity with a minimum of material and, in the embodiment illustrated, is of H-or I-cross-section.

Figure 2:
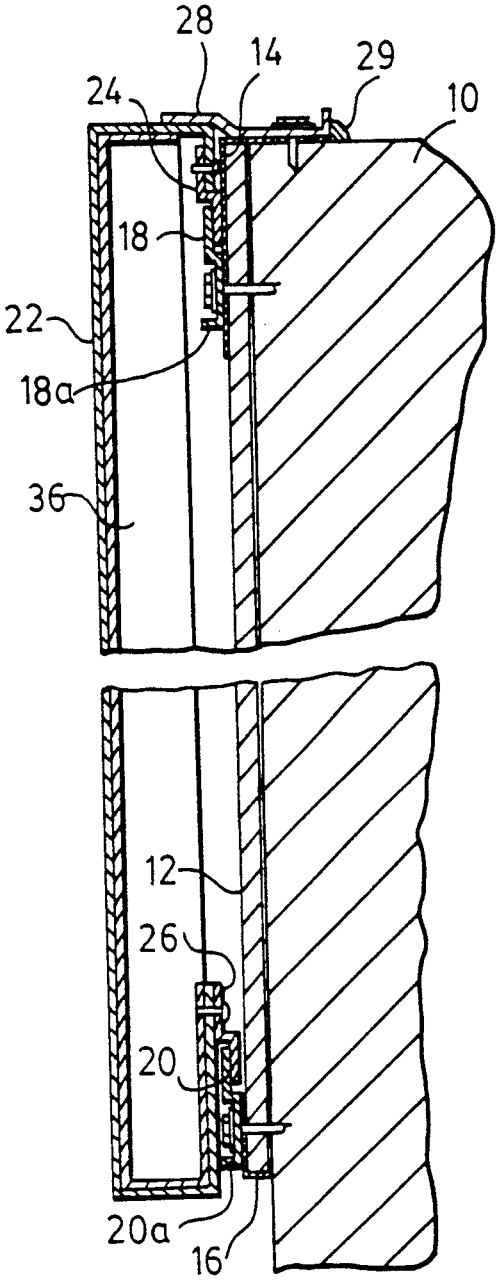
FIG. 2 is a vertical cross-section taken on the line 2—2 of FIG. 1, drawn to a larger scale, to show the means mounting the panels on the support structure.

The other vertical edge of the same panel is provided with a vertically-extending, tongue-forming and stiffener member 36, also fastened to the panel rear face by strip 38 of double-sided adhesive tape. Tongue portion 36*a* of the member is of substantial length and extends deeply into the channel 34 to hold the abutting panels in accurate alignment and also to fill any vertical gap G that appears between the two panels, the clearance actually obtained being greatly exaggerated in FIG. 3 for clarity of illustration. Referring also to FIG. 2, it will be seen that the tongue member 36 is shaped so that it also extends over the top and bottom panel edges and upwards at the bottom edge to extend parallel to the back portion of the panel, so that the joint between the panels is sufficiently closed to exclude the entry of moisture behind the panels; the hold down member 28 extends sufficiently far forward that it overlaps with the tongue member. The stiffener portion of this tongue-forming member is much simpler in cross-section, the whole member being of L-cross section.

The corners of the structure are finished by means of special L-shaped panels, the side opening between the special panel and the side of the structure being closed by an L-cross-section closure member 40 fastened to the panel rear wall by strip 42 of double sided adhesive tape. With the support members 18 and 20 firmly secured in place by fasteners at spaced intervals along their lengths, and the L-shaped end panel in place, the remaining panels are simply hooked on to the support members and slid into place with the tongues engaged in the respective channels, the small gap G, whose size depends upon the ambient temperature at the time of installation, and may be zero, being left if necessary between the immediately adjacent edges to take care of any expansion. The portion 20*a* of the lower horizontal support member 20 serves as a spacer member preventing rattling movement of the panel lower end toward and away from the plywood backing panel 12. The other end panel is put in place and upon installation of the elongated hold-down cap strip 26 the assembly is complete.

It will be seen that such a structure is "free-floating" in nature, in that each of the panels is able to move freely relative to its immediately adjacent panels, and relative to the support structure or which they are mounted, reducing considerably if not completely eliminating the possibility of distortion of panels and effects such as "oil-canning".

It will also be apparent that such structures can readily be shop pre-fabricated, considerably reducing the on-site labour that is required. At any time a panel or panels can readily be replaced, if required for repair, or for change of decoration or signage. The preferred material for the panels is sheet aluminum, or an alloy thereof, and any required surface finish can readily be applied prior to installation. The required signage indicia, such as the retail outlet identification, can easily be applied to the flat unobstructed front surfaces by relatively inexpensive processes, such as silk screening, and this identification can readily be changed at any time. The panels remain flat during their lifetime eliminating inconsistent deflection of light and the consequent unsightly appearance. All of the parts of the support structure can be of extruded aluminum sections, and with appropriate choice of non-corroding fasteners there is no component of the system that will corrode during the expected commercial life-time of the fascia (e.g. 5–10 years).

Although in the specific embodiment described double-sided adhesive tape is used to fasten the members 32,36 and 40 to the panels, other fastening methods can be used provided they do not marr the front panel surface. For example, it is possible to spot weld the members in place provided heat sinks of adequate size are provided at the front surface in the neighbourhood of the welds so that weld marks do not appear.

Figure 4:
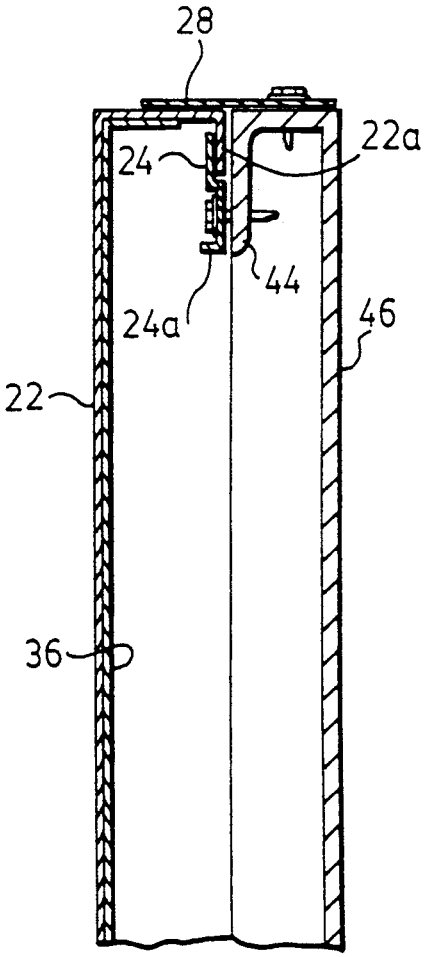
FIG. 4 is a vertical cross-section similar to FIG. 2 to show another embodiment.

Although in this specific embodiment the upper panel edge that hooks into the channel formed by the support member 18 is provided by the Z-section member 22, in another embodiment illustrated in FIG. 4, it is the edge of the panel itself that provides the necessary portion and is so engaged, in order to provide a less expensive structure. In this embodiment the horizontal support members are attached to respective elongated extrusions 44 (only the upper one is shown), which are in turn supported by a vertical elongated panel member 46 that is fastened in any suitable manner to the building structure. Other variations and modifications of the structure within the scope of the appended claims are also possible.

We claim:

1. A fascia panel structure including a plurality of panels in side-by-side butting relationship, comprising:

a) two vertically-spaceable, horizontally-extendible panel edge support means fastenable to the structure against which the fascia is to be supported and providing respective horizontal, parallel elongated upwardly-opening panel edge receiving channels;

b) a plurality of said panels each having a front face and respective rearwardly-extending portions along their upper and lower edges, the rearwardly extending portions each terminating in a respective downwardly-extending horizontal edge engageable in the respective support means channel to support the respective panel edge against vertical downward movement while permitting the panel to move freely sideways on the support means;

c) a vertically-extending channel-forming member attached to the rear face of each panel adjacent one vertical edge to provide a vertical tongue-receiving channel between itself and the said panel rear face;

d) a tongue-forming member attached to the rear face of each panel adjacent to the other vertical edge and forming a tongue protruding from the panel edge along its entire length to be engageable in the adjacent vertical tongue receiving channel and bridge any gap between the adjacent panels; and e) a hold down member fastenable to the said structure and engageable with the top edge of each panel to hold it against vertical movement and so that the said panel rearwardly-extending portions remain engaged in said support means channels.

2. A fascia panel structure as claimed in claim 1, wherein the hold down member is a continuous strip extending over the panels and closing the horizontal gap between the panels and the structure on which the fascia is supported.

3. A fascia panel structure as claimed in claim 1, wherein the panel downwardly extending horizontal edges are provided by separate extruded members fastened to the respective edge portions of the panel.

4. A fascia panel structure as claimed in claim 3, wherein the hold down member is a continuous strip extending over the panels and closing the horizontal gap between the panels and the structure on which the fascia is supported.

5. A fascia panel structure as claimed in claim 1, wherein the said channel and tongue forming members are glued to the panel rear face.

6. A fascia panel structure as claimed in claim 5, wherein the panel downwardly extending horizontal edges are provided by separate extruded members fastened to the respective edge portions of the panel.

7. A fascia panel structure as claimed in claim 5, wherein the hold down member is a continuous strip extending over the panels and closing the horizontal gap between the panels and the structure on which the fascia is supported.

8. A fascia panel structure as claimed in claim 1, wherein the said channel and tongue forming members are glued to the panel rear face by double sided adhesive tape interposed between the members and the panel rear face.

9. A fascia panel structure as claimed in claim 8, wherein the panel downwardly extending horizontal edges are provided by separate extruded members fastened to the respective edge portions of the panel.

10. A fascia panel structure as claimed in claim 8, wherein the hold down member is a continuous strip extending over the panels and closing the horizontal gap between the panels and the structure on which the fascia is supported.

* * * * *